US010149065B2

(12) United States Patent
Tiefenau et al.

(10) Patent No.: US 10,149,065 B2
(45) Date of Patent: Dec. 4, 2018

(54) VIBRATION COMPENSATED VIBRO ACOUSTICAL ASSEMBLY

(71) Applicant: Sonion Nederland B.V., Hoofddorp (NL)

(72) Inventors: Andreas Tiefenau, Hoofddorp (NL); Koen van Gilst, Hoofddorp (NL); Laurens de Ruijter, Hoofddorp (NL); Nicolaas Maria Jozef Stoffels, Hoofddorp (NL); Mike Geskus, Hoofddorp (NL); Rasmus Voss, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/297,769

(22) Filed: Oct. 19, 2016

(65) Prior Publication Data

US 2017/0118553 A1 Apr. 27, 2017

(30) Foreign Application Priority Data

Oct. 21, 2015 (EP) ..... 15190815

(51) Int. Cl.

| | |
|---|---|
| ***H04R 11/02*** | (2006.01) |
| ***H04R 1/24*** | (2006.01) |
| ***H04R 25/00*** | (2006.01) |
| ***H04R 1/28*** | (2006.01) |

(52) U.S. Cl.

CPC ..... *H04R 11/02* (2013.01); *H04R 1/245* (2013.01); *H04R 1/2873* (2013.01); *H04R 25/48* (2013.01); *H04R 25/604* (2013.01); *H04R 25/652* (2013.01); *H04R 2201/003* (2013.01)

(58) Field of Classification Search

CPC ..... H04R 11/00; H04R 11/02; H04R 11/04; H04R 11/06; H04R 11/14; H04R 25/604; H04R 25/608; H04R 31/003; H04R 31/006; H04R 2400/01; H04R 2400/07; B06B 1/045

See application file for complete search history.

(56) References Cited

U.S. PATENT DOCUMENTS

| | | | |
|---|---|---|---|
| 6,788,796 | B1 | 9/2004 | Miles et al. |
| 6,831,577 | B1 | 12/2004 | Furst |
| 6,853,290 | B2 | 2/2005 | Jorgensen et al. |

(Continued)

FOREIGN PATENT DOCUMENTS

| | | |
|---|---|---|
| CN | 101 064 972 | 12/2012 |

OTHER PUBLICATIONS

Extended European Search Report for European Application No. EP 16 19 4185 dated Mar. 3, 2017 (3 pages).

(Continued)

*Primary Examiner* — Joshua Kaufman

(74) *Attorney, Agent, or Firm* — Nixon Peabody LLP

(57) ABSTRACT

The present invention relates to an acoustical assembly extending in the x, y, and z directions, the acoustical assembly comprising first and second receiver units being spatially shifted relative to each other in the x direction thereby creating regions with free and available space, and one or more microphone units being positioned in the regions with free and available space. The present invention further relates to a hearing device comprising such an acoustical assembly.

17 Claims, 7 Drawing Sheets

(56) References Cited

U.S. PATENT DOCUMENTS

| | | | |
|---|---|---|---|
| 6,859,542 | B2 | 2/2005 | Johannsen et al. |
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |
| 6,930,259 | B1 | 8/2005 | Jorgensen et al. |
| 6,943,308 | B2 | 9/2005 | Ravnkilde et al. |
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |
| 7,062,063 | B2 | 6/2006 | Hansen et al. |
| 7,072,482 | B2 | 7/2006 | Van Doorn et al. |
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenborn et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenborn et al. |
| 7,221,769 | B1 | 5/2007 | Jorgensen |
| 7,227,968 | B2 | 6/2007 | van Halteren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosh et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 2009/0252361 | A1* | 10/2009 | van Halteren ..... H04R 25/00 381/328 |
| 2011/0182453 | A1 | 7/2011 | van Hal et al. |
| 2011/0189880 | A1 | 8/2011 | Bondo et al. |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1* | 10/2012 | van Halteren ..... H04R 11/02 181/199 |
| 2013/0028451 | A1 | 1/2013 | de Roo |
| 2013/0136284 | A1 | 5/2013 | van Hal et al. |
| 2013/0142370 | A1 | 6/2013 | Engbert et al. |
| 2013/0163799 | A1 | 6/2013 | Van Halteren |
| 2013/0195295 | A1 | 8/2013 | van Halteren et al. |
| 2014/0205131 | A1* | 7/2014 | Azmi ..... H04R 1/1075 381/380 |
| 2014/0305735 | A1 | 10/2014 | van Halteren et al. |

OTHER PUBLICATIONS

European Search Report for Application No. EP 15190815, dated Feb. 4, 2016 (3 pages).

* cited by examiner

VIBRATION COMPENSATED VIBRO ACOUSTICAL ASSEMBLY

CROSS REFERENCE TO RELATED APPLICATIONS

This application claims the benefit of European Patent Application Serial No. EP 15190815.9, filed Oct. 21, 2015, and titled "Vibration Compensated Vibro Acoustical Assembly," which is incorporated herein by reference in its entirety.

FIELD OF THE INVENTION

The present invention relates to a vibration compensated vibro acoustical assembly comprising a plurality of receiver units. In particular, the present invention relates to a vibro acoustical assembly where at least two receivers are mutually positioned in a manner so as to create space for one or more microphone units as well as to counteract self-generated vibrations.

BACKGROUND OF THE INVENTION

In general, vibrations are problematic when dealing with acoustical assemblies for hearing devices, including hearing aids. In particular, vibrations generated by the acoustical assembly itself, for example self-generated receiver vibrations, are a huge problem and should be dealt with in order to avoid acoustical feedback problems within the assembly.

One approach to reduce self-generated vibrations is suggested by the applicant in US 2012/0255805 A1. In this particular reference an arrangement for reducing vibrations in the x and z directions are proposed, cf. in particular FIGS. 5 and 6 of US 2012/0255805 A1.

The arrangement proposed US 2012/0255805 A1 applies two oppositely arranged, and spatially shifted, moving armature receivers. As addressed in for example paragraphs [0063] and [0064] vibrations in the x and z directions are reduced. However, the oppositely arranged forces in the x and z directions introduce an unintended torque in the y direction around the centre of mass of the arrangements shown in FIGS. 5 and 6.

It may be seen as an object of embodiment of the present invention to provide a vibro acoustical assembly where also torque induced vibrations are reduced.

It may be seen as a further embodiment of the present invention to provide a vibro acoustical assembly where a plurality of receivers are arranged in a manner that creates space for an inclusion of one or more microphone units.

DESCRIPTION OF THE INVENTION

The above-mentioned objects are complied with by providing, in a first aspect, an acoustical assembly extending in the x, y, and z directions, the acoustical assembly comprising (1) first and second receiver units being spatially shifted relative to each other in the x direction thereby creating regions with free and available space, and (2) one or more microphone units being positioned in the regions with free and available space.

The first receiver unit may have a first primary direction of movement being essentially parallel to the z direction. Similarly, the second receiver unit may have a second primary direction of movement being essentially parallel to the z direction, said second primary direction being essentially opposite to the first primary direction, The first and second receiver units may be spatially shifted relative to each other in at least the x and z directions so as to counteract self-generated receiver vibrations in the x and z directions, and to counteract self-generated torque-related vibrations in the y direction.

The acoustical assembly of the present invention may be considered a so-called vibro acoustical assembly. However, in the following, the more general term acoustical assembly will be used.

Thus, the present invention relates to an acoustical assembly where at least two receiver units are mutually positioned in a manner so that the assembly as a whole may be considered a vibration free assembly. The receiver units may be (1) oppositely arranged and (2) spatially shifted in the x and z directions whereby vibrations, in case of two identical receiver units, may cancel out in these directions. Moreover, vibrations due to torque in the y direction may be eliminated as well.

In the present context self-generated receiver vibrations are to be understood as vibrations being generated by the receiver units themselves upon activation thereof.

The first and second receiver units may be spatially shifted in a manner so that there is essentially no projected spatial overlap between the first and second receiver units in the z direction. Moreover, the first and second receiver units may be spatially shifted in a manner so that there is essentially no projected spatial overlap between the first and second receiver units in the x direction. The term projected spatial overlap is here to be understood as follows: if the outermost points of the first receiver unit are projected in the x and z directions then any points of the second receiver unit will not fall inside the projected areas.

The first and second receiver units are mechanically connected to each other via a substantially rigid connection, i.e. hard connected. Alternatively they may be connected via a flexible connection, such as via a suspension member. The latter may be relevant in case the first and second receiver units are different types of receiver units, i.e. receiver units that generate different vibration frequency responses.

Each of the first and second receiver units may comprise a moving armature type receiver, such as a balanced moving armature receiver. However, alternative types of receiver units, like moving coil receivers or doorbell type receivers may be applicable as well.

The acoustical assembly of the present invention may further comprise a first microphone unit. The microphone unit may be mechanically connected to the receiver units via a substantially rigid connection, i.e. hard connected, or connected via a flexible connection, such as a suspension member. The acoustical assembly of the present invention may further comprise a second microphone unit being mechanically connected to the receivers units via a substantially rigid connection, i.e. hard connected, or connected via a flexible connection, such as a suspension member.

Each of the first and second microphone units may comprise a first and a second microphone, respectively, each microphone having a primary vibration sensitive direction. The primary vibration sensitive direction of the microphones may, in principle, be oriented in any direction. In one embodiment, the primary vibration sensitive direction of the first and second microphones may be essentially parallel to the y direction which is the direction with the smallest self-generated receiver vibrations. In another embodiment, the primary vibration sensitive direction of the first and second microphones may be essentially perpendicular to each other, such as in the x and y directions.

The acoustical assembly may further comprise additional microphone units with additional microphones. The microphones of the microphone units may be MEMS microphones and/or electret microphones.

The acoustical assembly of the present invention may further comprise signal processing means for providing a directional sensitivity from signals from the first and second microphones. Thus, by proper processing of the signals from the microphone units, directional sensitivity of the assembly as a whole may be provided. Each microphone unit may comprise its own signal processor, such as an ASIC, for proper local processing of the signals from the microphones.

The first and second receiver units may in principle be chosen arbitrary. Thus, the first and second receiver units may be selected to have essentially identical acoustic and vibration frequency responses. Alternatively, the first and second receiver units may be selected to have different acoustic frequency responses, but essentially identical vibration frequency responses in the whole frequency range or in a relevant part of the frequency range. As an example the acoustical assembly of the present invention may comprise a woofer for low-frequency response and a tweeter for high-frequency response.

The term "acoustic frequency response" as used herein should be understood as the sound frequency response of the receiver unit. Similarly, the term "vibration frequency response" as used herein should be understood as the receiver generated vibration force(s) over the sound frequency.

The acoustical assembly may further comprise a flexible structure being either secured to or integrated with a housing of the acoustical assembly. The flexible structure is adapted to provide an easy, user friendly and comfortable mounting of the acoustical assembly in an ear canal. The flexible structure may comprise a dome-shaped flexible structure that is made of materials like rubber, silicone or similar soft and flexible materials.

In a second aspect, the present invention relates to a hearing device comprising an acoustical assembly according to the first aspect. The hearing device may comprise a hearing aid, including behind-the-ear (BTE) hearing aids, receiver-in-the-canal (RIC) hearing aids, in-the-ear (ITE) hearing aids, in-the-canal (ITC) hearing aids, and completely-in-the-canal (CTC) hearing aids.

BRIEF DESCRIPTION OF THE DRAWINGS

The present invention will now be described in further details with reference to the accompanying figures.

FIG. 4*a* shows an open version of the acoustical assembly of FIG. 4*a*.

Figure 1:
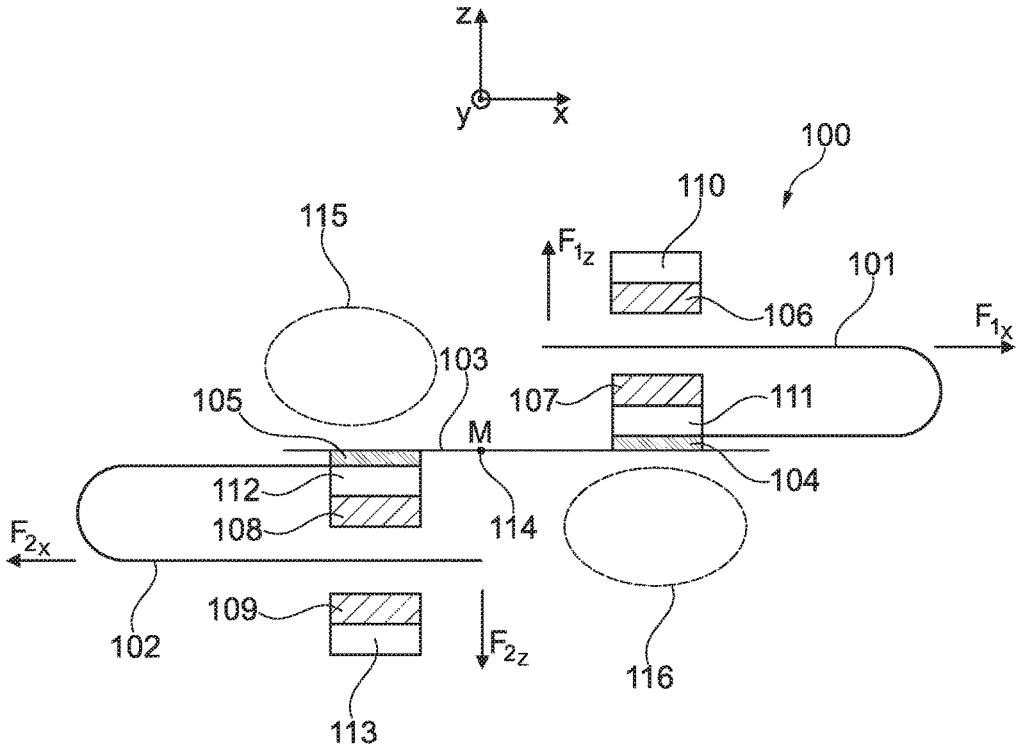
FIG. 1 shows a pair of spatially shifted moving armature receivers.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect, the present invention relates to an acoustical assembly where two acoustical receivers are spatially arranged in a manner so that self-generated vibrations are essentially eliminated, or at least effectively reduced. The two acoustical receivers may, for example, be two moving armature receivers, such as balanced armature receivers. In the acoustical assembly of the present invention the two moving armature type receivers are positioned up-side down in a x, y and z coordinate system with the main flux direction being parallel to the z direction. The legs of the two oppositely arranged U-shaped armatures are oriented parallel to the x direction. To overcome the disadvantages of prior art arrangements, the two moving armature type receivers are spatially shifted along both the x and z directions. The combination of this double-shift reduces the torque-induced vibrations.

Referring now to FIG. 1, a cross-sectional view of an acoustical assembly 100 of the present invention is depicted. As seen, two moving armature receivers are mechanically connected via a rigid connection 103 and spacers 104, 105. The rigid connection 103 intersects the centre of mass 114 of the assembly. As indicated in FIG. 1 the x direction is in the horizontal direction, whereas the z direction is in the vertical direction. Consequently the y direction is perpendicular to the plane of the drawing.

Still referring to FIG. 1, each moving armature receiver comprises a U-shaped armature 101, 102, magnet housings 110, 111 and 112 and 113 and permanent magnets 106, 107 and 108 and 109. The two moving armature receivers are arranged oppositely in the z direction. Thus, then the upper leg of the armature 101 moves up, the lower leg of the armature 102 moves down. Thus, forces acting in the z direction (denoted $F_{1z}$ and $F_{2z}$) are oppositely directed and therefore cancels out. Similarly, forces acting in the x direction (denoted $F_{1x}$ and $F_{2x}$) are also oppositely directed and therefore cancels. The torque-induced vibrations in the y direction are counteracted by the combined forces $F_{1z}$, $F_{2z}$ and $F_{1x}$, $F_{2x}$.

In addition to the above-mentioned vibrations issues the proposed shifting of the moving armature receivers created free and available space in the two regions 115, 116. Advantageously, one or more microphone units may be positioned in these regions 115, 116, cf. also FIG. 2. With for example two microphone units directional sensitivity in the x direction can be established. This directional sensitivity can for example be used to reduce feedback.

In conclusion, the following immediate advantages are associated with the acoustical assembly of the present invention: (1) compact assembly, (2) vibration reduction in the x, y and z directions, (3) facilitates hard mount of microphones to receivers, (4) available space for suspension of microphones which may decouple remaining receiver/microphone vibrations even further, and (5) large distance between the microphone inlets which facilitates a better performance of the resulting directional microphone. This can also be used to reduce feedback problems.

Figure 2:
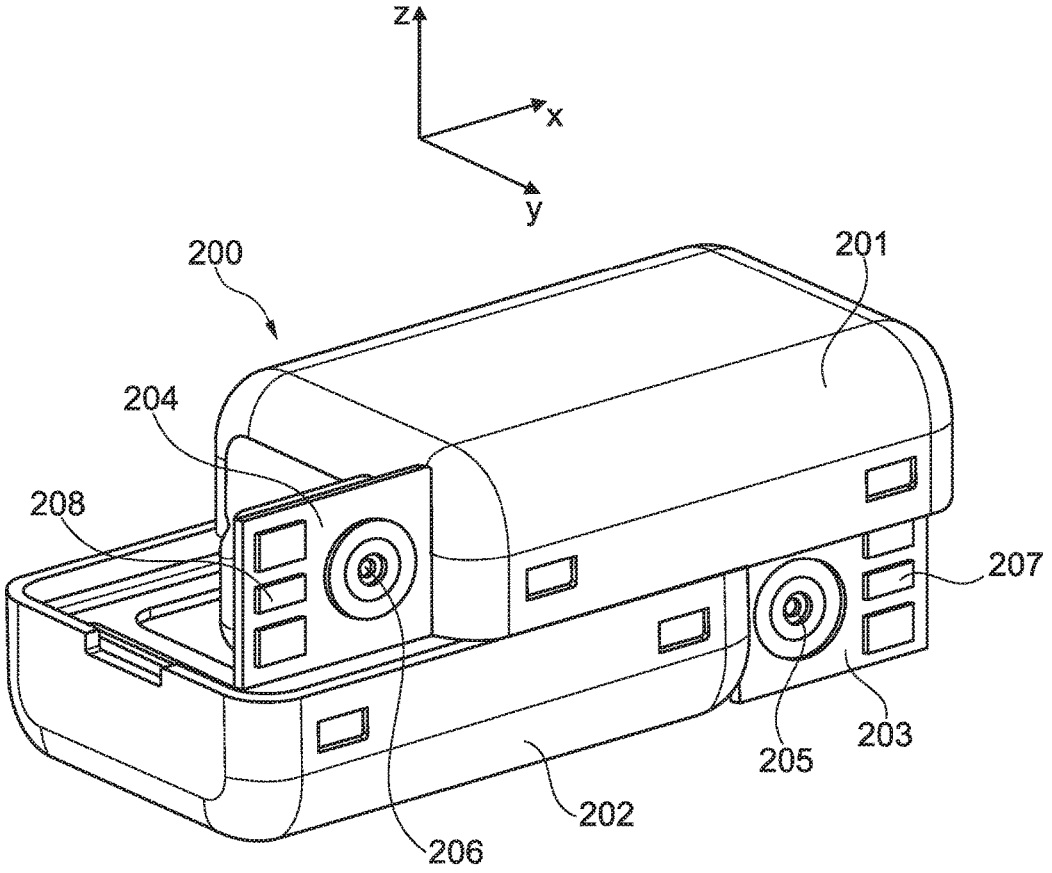
FIG. 2 shows a pair of spatially shifted receiver units and a pair of spatially shifted microphone units.

Referring now to FIG. 2, an acoustical assembly 200 comprising two receiver housings 201, 202 is depicted. Each of the receiver housing 201, 202 may comprise a moving armature receiver, such as a balanced moving armature receiver as depicted in FIG. 1. The moving armature receivers are mutually arranged as depicted in FIG. 1, i.e. with no spatial overlap in the x direction.

As seen in FIG. 2, the receivers housings 201, 202 are spatially shifted relative to each other in the longitudinal direction of the assembly 200 (x direction) as well as in the vertical direction of the assembly 200 (z direction). The longitudinal shift of the receiver housings 201, 202 creates space for the microphone units 203, 204 in the corners of the assembly 200. As the receiver housings 201, 202 are mutually arranged to cancel self-generated vibrations in all three directions the microphone units 203, 204 can be hard mounted to the assembly, i.e. without being suspended in a suspension arrangement. However, it should be noted that there is sufficient space to suspend the microphones units 203, 204 if required. Suspension of the microphone unit 203, 204 may be advantageous in case the receiver housings 201, 202 are different, for example in case of a tweeter/woofer configuration.

Each of the microphone units 203, 204 comprise respective microphones 205, 206 and electrical contact pads 207, 208. Moreover, each microphone may advantageously comprise a signal processing circuitry (not shown) for processing signals from the respective microphones.

In FIG. 2, the microphones 205, 206 are oriented in the direction being exposed to the smallest amount of vibrations, i.e. the y direction. Obviously, the microphones 205, 206 may also face or being directed in other directions. Typically, the microphones 205, 206 are MEMS microphones and/or electret microphones.

Moreover, an additional signal processor circuitry (also not shown) may be provided in order to generate for example directional sensitivity by using signals from the two microphone units 203, 204. As previously addressed, additional microphone units or microphones may be applied as well. Additional microphone units or microphones may advantageously be applied if an influence of remaining vibrations in the y direction needs to be eliminated in order to improve the signal-to-noise ratio.

Figure 3:
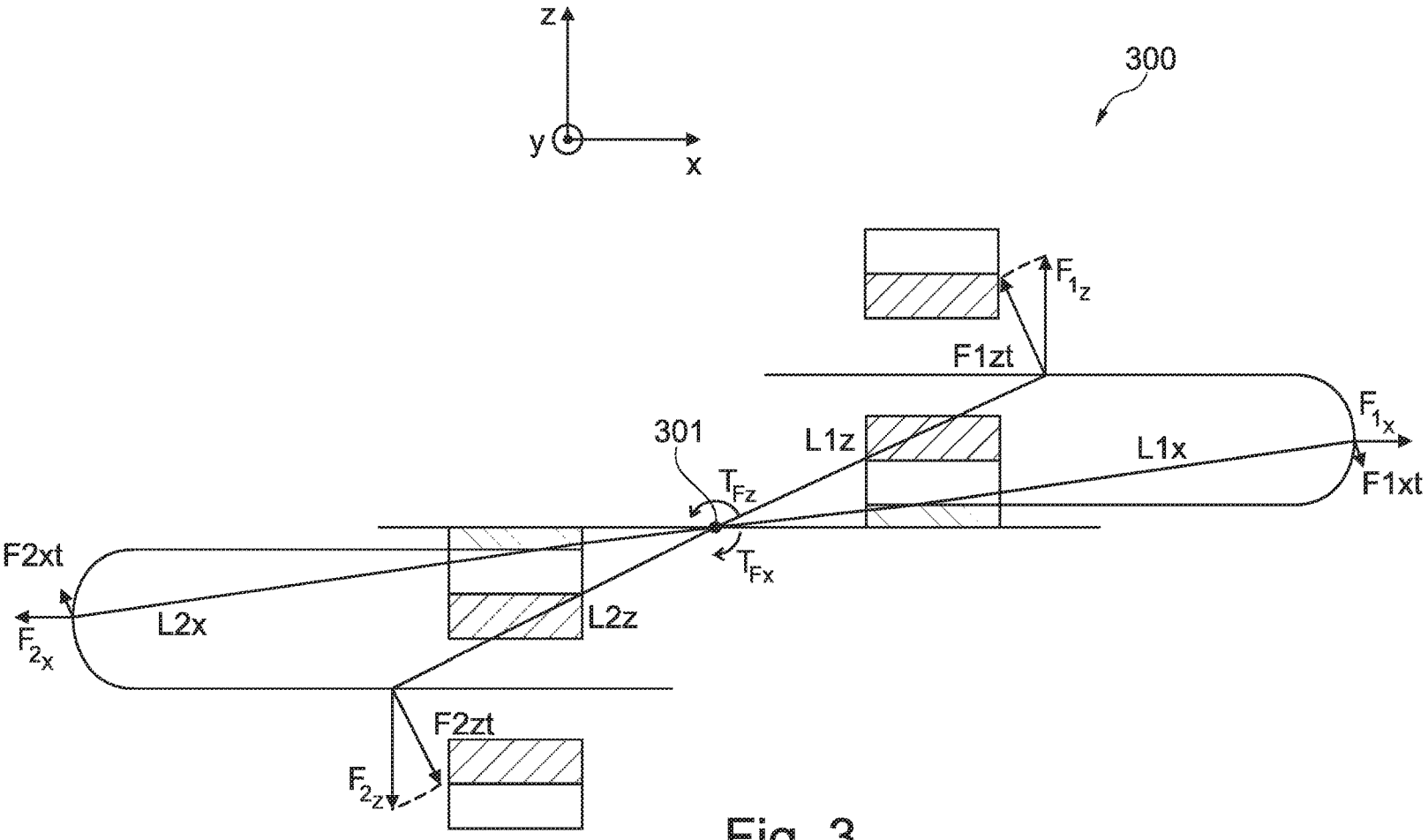
FIG. 3 illustrates the various forces.

In FIG. 3, the various involved forces being generated by the microphone assembly 300 are depicted. The force components F1$xt$, F2$xt$ and F1$zt$, F2$zt$ are the components that introduce the torque. The remaining force components do not have any impact in relation to torques. The x and z relates torques, $T_{Fx}$ and $T_{Fz}$, may be expressed as follows:

$$T_{Fx}=F1xt\times L1x+F2xt\times L2x$$

$$T_{Fz}=F1zt\times L1z+F2zt\times L2z$$

As depicted in FIG. 3 the torques $T_{Fx}$ and $T_{Fz}$ have opposite directions around the centre of mass 301. Thus, a complete cancelation of the torques will take place if they are equal in size. A complete cancelation can be provided by shifting both receiver halves, i.e. changing the length of the arms, L1$x$, L2$x$, L1$z$, L2$z$, relating to the forces. At a certain shift, the torques will obviously cancel completely.

Figure 4A:
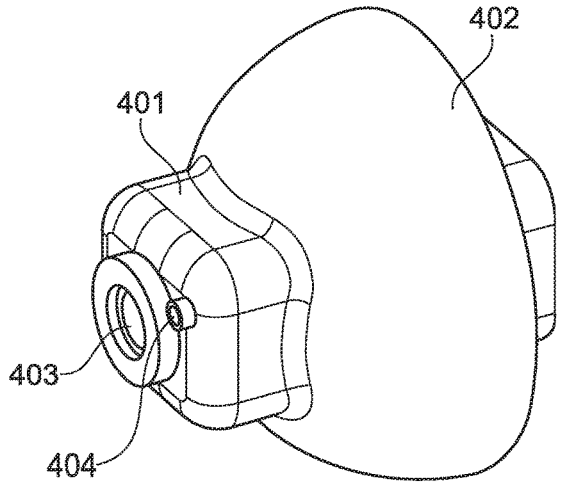
FIG. 4*a* shows a first embodiment of an acoustical assembly.

FIG. 4*a* shows a pair of spatially shifted receiver units and a pair of spatially shifted microphone units assembled in a housing 401. A flexible dome shaped structure 402 is either secured to the housing 401 or integrated with the housing 401 in order to provide an easy, user friendly and comfortable mounting of the assembly in the ear canal. Moreover, the flexible dome shaped structure 402 may form an acoustical filter between the sound inlets of the microphone units where only one sound inlet 404 is visible in FIG. 4*a*. The other sound inlet is hidden behind the flexible dome shaped structure 402, cf. instead FIG. 4*b*. The spatially shifted receiver units are acoustically interconnected via an opening between the receiver units. The acoustical interconnection between the receiver units provides that the spatially shifted receiver units may have a common sound outlet 403 which is acoustically connected to one of the receiver units via a tube.

Figure 4B:
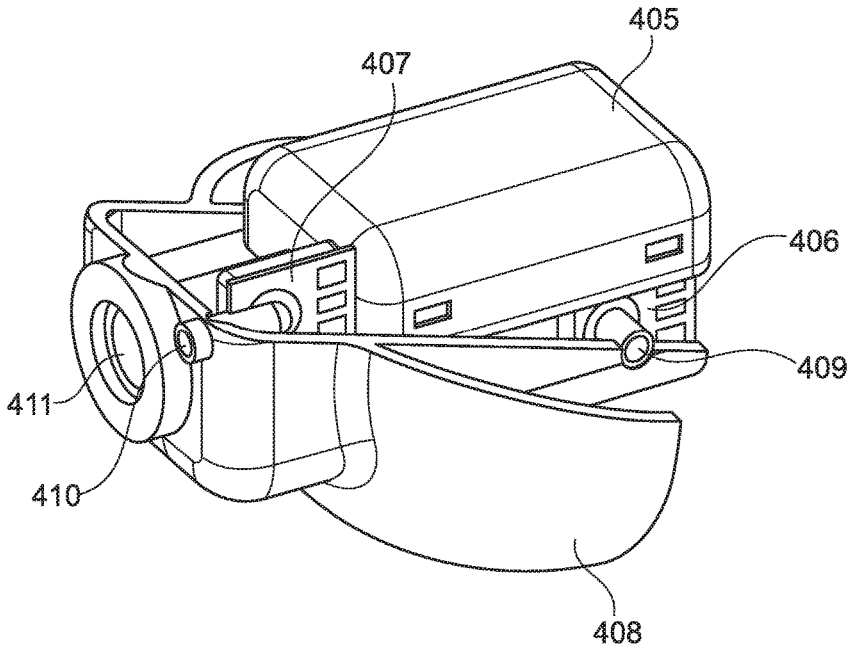

Turning now to FIG. 4*b*, an open version of the assembly of FIG. 4*a* is depicted. The assembly shown in FIG. 4*b* comprises a pair of spatially shifted receiver units 405 and a pair of spatially shifted microphone units 406, 407. In FIG. 4*b*, only one receiver unit 405 is visible. The microphone units 406, 407 have respective sound inlets 409, 410 being oriented in different directions. The flexible dome shaped structure 408 is positioned between the sound inlets 409, 410 and may, as mentioned above, form an acoustical filter between the sound inlets 409, 410. The common sound outlet 411 of the two receiver units is oriented essentially parallel to the sound inlet 410 whereas the sound inlet 409 is arranged essentially perpendicular thereto. Optionally, the sound inlets 409, 410 may be used as ventings opening for the two receiver units. Alternatively, dedicated venting openings (not shown) for the receiver units may be provided.

The receiver units may each comprise a moving armature type receiver, such as a balanced moving armature receiver. Moreover, the receiver unit may be mutually hard connected. The microphones units 406, 407 may comprise MEMS microphones and/or electret microphones. Moreover, the microphone units 406, 407 can be hard mounted to the assembly, i.e. without being suspended in a suspension arrangement. Alternatively, the microphone units 406, 407 may be suspended in a suspension arrangement in order to vibrationally isolate the microphone units 406, 407 from the receiver units.

Figure 5A:
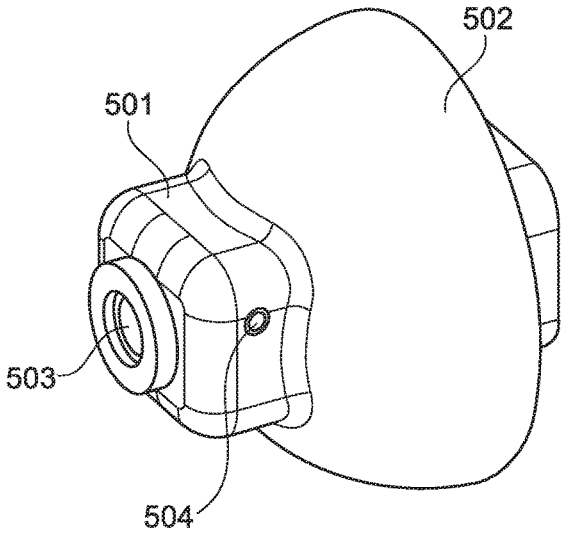
FIG. 5*a* shows a second embodiment of an acoustical assembly.

In FIG. 5*a*, a pair of spatially shifted receiver units and a pair of spatially shifted microphone units assembled in a housing 501 are depicted. A flexible dome shaped structure 502 is either secured to the housing 501 or integrated therewith in order to provide an easy, user friendly and comfortable mounting of the assembly in the ear canal. Moreover, the flexible dome shaped structure 502 may form an acoustical filter between the sound inlets of the microphone units where only one sound inlet 504 is visible in FIG. 5*a*. The other sound inlet is hidden behind the flexible dome shaped structure 502, cf. instead FIG. 5*b*. The spatially shifted receiver units are acoustically interconnected via an opening between the receiver units. The acoustical interconnection between the receiver units provides that the spatially shifted receiver units may have a common sound outlet 503 which is acoustically connected to one of the receiver units via a tube.

Figure 5B:
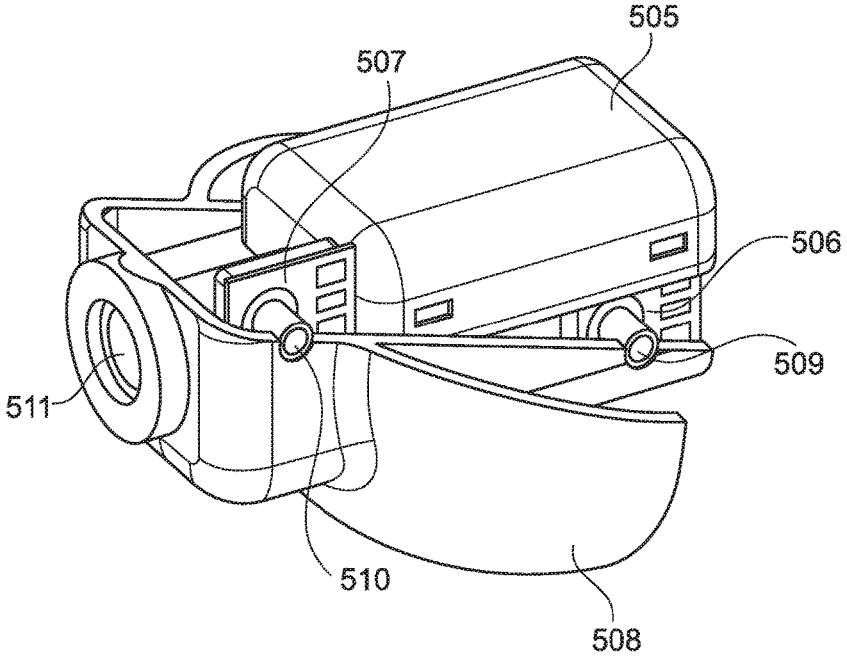
FIG. 5*b* shows an open version of the acoustical assembly of FIG. 5*b*.

Turning now to FIG. 5*b*, an open version of the assembly of FIG. 5*a* is depicted. Similar to FIG. 4*b* the assembly shown in FIG. 5*b* comprises a pair of spatially shifted receiver units 505 and a pair of spatially shifted microphone units 506, 507. However, in FIG. 5*b* only one receiver unit 505 is visible. The microphone units 506, 507 have respective sound inlets 509, 510 being oriented in essentially the same direction. The flexible dome shaped structure 508 is positioned between the sound inlets 509, 510 and may, as mentioned above, form an acoustical filter between the sound inlets 509, 510. The common sound outlet 511 of the two receiver units is oriented in a direction being essentially perpendicular to the sound inlets 509, 510. Optionally, the sound inlets 509, 510 may be used as venting openings for the two receiver units. Alternatively, dedicated venting openings (not shown) for the receiver units may be provided.

Similar to FIG. 4, the receiver units may each comprise a moving armature type receiver, such as a balanced moving armature receiver. Moreover, the receiver unit may be mutually hard connected. The microphones units 506, 507 may comprise MEMS microphones and/or electret microphones. Moreover, the microphone units 506, 507 can be hard mounted to the assembly, i.e. without being suspended in a suspension arrangement. Alternatively, the microphone units 506, 507 may be suspended in a suspension arrangement in order to isolate vibrationally the microphone units 506, 507 from the receiver units.

Figure 6A:
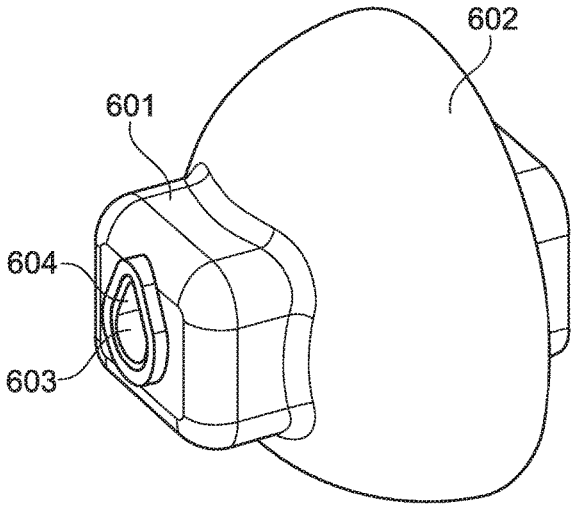
FIG. 6*a* shows a third embodiment of an acoustical assembly.

In FIG. 6*a* a pair of spatially shifted receiver units and a pair of spatially shifted microphone units assembled in a housing 601 are depicted. A flexible dome shaped structure 602 is either secured to the housing 601 or integrated therewith in order to provide an easy, user friendly and comfortable mounting of the assembly in the ear canal. Moreover, the flexible dome shaped structure 602 may form an acoustical filter between the sound inlets of the microphone units where only one sound inlet 604 is visible in FIG. 6*a*. The sound inlet 604 is defined as an upper region of an opening that also forms a common sound outlet 603 from the receiver units. The other sound inlet is hidden behind the flexible dome shaped structure 602, cf. instead FIG. 6*b*. The spatially shifted receiver units are acoustically interconnected via an opening between the receiver units. The acoustical interconnection between the receiver units provides that the spatially shifted receiver units may have the common sound outlet 603 which is acoustically connected to one of the receiver units via a tube.

Figure 6B:
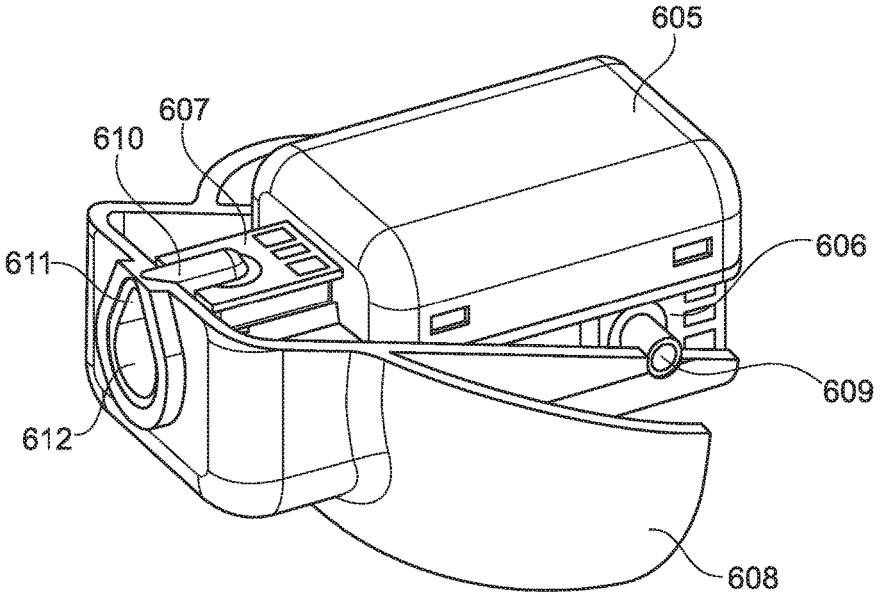
FIG. 6*b* shows an open version of the acoustical assembly of FIG. 6*a*.

Turning now to FIG. 6*b*, an open version of the assembly of FIG. 6*a* is depicted. The assembly shown in FIG. 6*b* comprises a pair of spatially shifted receiver units 605 and a pair of spatially shifted microphone units 606, 607. However, in FIG. 6*b*, only one receiver unit 605 is visible. The microphone units 606, 607 have respective sound inlets 609, 611 being oriented in essentially perpendicular directions. Moreover, the microphone units 606, 607 are arranged in a different manner in that they are mutually angled with around 90 degrees. A flat tube 610 connects the microphone unit 607 with the sound inlet 611.

The flexible dome shaped structure 608 is positioned between the sound inlets 609, 611 and may, as mentioned above, form an acoustical filter between the sound inlets 609, 611. The common sound outlet 612 of the two receiver units is oriented in a direction being essentially perpendicular to the sound inlet 609. Optionally, the sound inlets 609, 611 may be used as venting openings for the two receiver units. Alternatively, dedicated venting openings (not shown) for the receiver units may be provided.

Similar to FIGS. 4 and 5, the receiver units may each comprise a moving armature type receiver, such as a balanced moving armature receiver. Moreover, the receiver unit may be mutually hard connected. The microphones units 606, 607 may comprise MEMS microphones and/or electret microphones. Moreover, the microphone units 606, 607 can be hard mounted to the assembly, i.e. without being suspended in a suspension arrangement. Alternatively, the microphone units 606, 607 may be suspended in a suspension arrangement in order to vibrationally isolate the microphone units 606, 607 from the receiver units.

Figure 7:
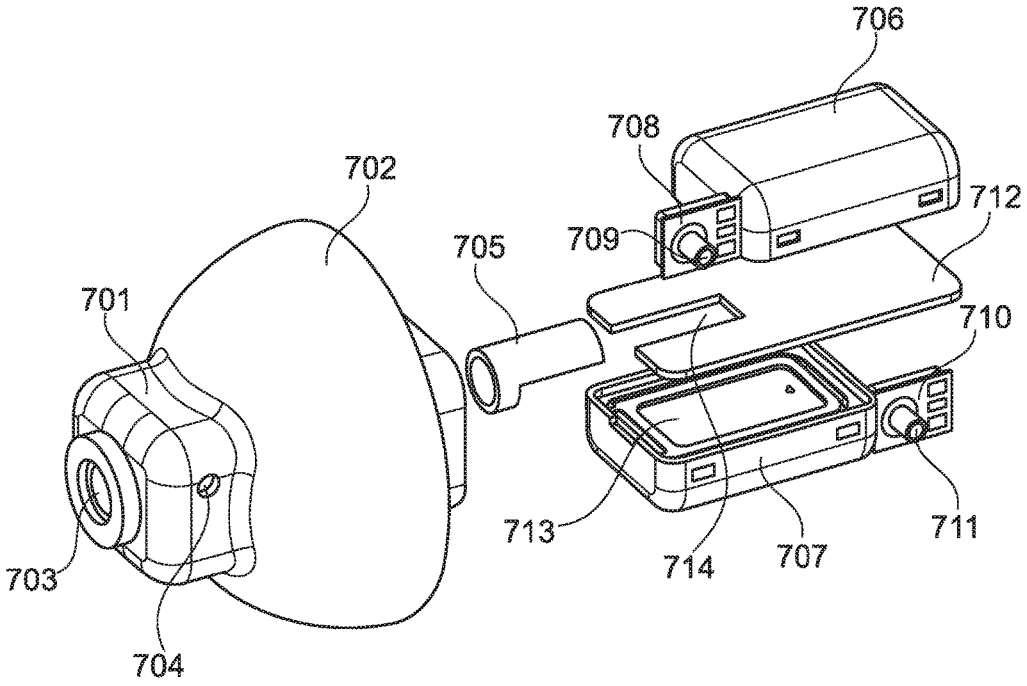
FIG. 7 shows an exploded view of an acoustical assembly.

FIG. 7 shows an exploded view of an assembly. Similar to FIGS. 4-6, a housing 701 having a flexible dome shaped structure 702 either attached thereto or integrated therewith. The housing comprises one opening 703 for sound outlet and two openings 704 (only one is visible) for sound inlet. The inside of the opening comprises a pair of spatially shifted receiver units 706, 707 and a pair of spatially shifted microphone units 708, 710 having respective sound inlets 709, 711. The receiver units 706, 707 are separated by a plate 712 having an opening 714 provided therein. This opening 714 ensures that sound from the receiver 713 can reach the opening 703 via the tube 705 when the arrangement is assembled.

The invention claimed is:

1. An acoustical assembly extending in the x, y, and z directions, the acoustical assembly comprising:

first and second receiver units being spatially shifted relative to each other in the x direction and in the z direction thereby creating first and second regions with free and available space, the spatially shifted arrangement counteracting self-generated receiver vibrations in the x and z directions and self-generated torque-related vibrations in the v direction, the first and second regions being shifted relative to each other in the x direction and in the z direction, and aligned at least partially relative to at least one of the first and second receiver units at least in one of the x direction or the z direction; and one or more microphone units being positioned in each of the regions with free and available space.

2. An acoustical assembly according to claim 1, wherein the first receiver unit has a first primary direction of movement being essentially parallel to the z direction, and wherein the second receiver unit has a second primary direction of movement being essentially parallel to the z direction, the second primary direction being essentially opposite to the first primary direction.

3. An acoustical assembly according to claim 1, wherein the first and second receiver units are spatially shifted in the x direction so that there is essentially no projected spatial overlap between the first and second receiver units in the z direction.

4. An acoustical assembly according to claim 1, wherein the first and second receiver units are spatially shifted in the z direction so that there is essentially no projected spatial overlap between the first and second receiver units in the x direction.

5. An acoustical assembly according to claim 1, wherein each of the first and second receiver units comprises a moving armature type receiver.

6. An acoustical assembly according to claim 5, wherein the moving armature type receiver is a balanced moving armature receiver.

7. An acoustical assembly according to claim 1, wherein the one or more microphone units include a first microphone unit in the first region and a second microphone unit in the second region, the first microphone unit comprising a first microphone having a primary vibration sensitive direction, and the second microphone unit comprising a second microphone having a primary vibration sensitive direction.

8. An acoustical assembly according to claim 7, wherein the primary vibration sensitive directions of the first and second microphones are essentially parallel to the y direction.

9. An acoustical assembly according to claim 7, wherein the primary vibration sensitive directions of the first and second microphones are essentially perpendicular to each other.

10. An acoustical assembly according to claim 7, wherein the first and second microphone units are mechanically connected to the receiver units via a substantially rigid connection or via a flexible connection.

11. An acoustical assembly according to claim 7, wherein at least one of the first and second microphones comprises a MEMS microphone or an electret microphone.

12. An acoustical assembly according to claim 7, further comprising a signal processor for providing a directional sensitivity from signals from the first and second microphones.

13. An acoustical assembly according to claim 1, wherein the first and second receiver units have essentially identical acoustic and vibration frequency responses.

14. An acoustical assembly according to claim 1, wherein the first and second receiver units have different acoustic frequency responses, but essentially identical vibration frequency responses.

15. An acoustical assembly according to claim 14, wherein the first and second receiver units are woofer and tweeter receiver units, respectively.

16. An acoustical assembly according to claim 1, further comprising a flexible structure being either secured to or integrated with a housing of the acoustical assembly, the flexible structure being adapted to provide an easy, user friendly and comfortable mounting of the acoustical assembly in an ear canal.

17. A hearing device comprising an acoustical assembly according to claim 1, the hearing device comprising a hearing aid being selected from the group consisting of: behind-the-ear, in-the-ear, in-the-canal and completely-in-the-canal.

* * * * *